US007980546B2

(12) United States Patent
Lee

(10) Patent No.: US 7,980,546 B2
(45) Date of Patent: Jul. 19, 2011

(54) MAIL PAPER SEALING APPARATUS

(75) Inventor: Jong Koo Lee, Goyang-si (KR)

(73) Assignee: Well Tec System, Goyang-Si, Gyeonggi-Do (KR)

( * ) Notice: Subject to any disclaimer, the term of this patent is extended or adjusted under 35 U.S.C. 154(b) by 40 days.

(21) Appl. No.: 12/512,432

(22) Filed: Jul. 30, 2009

(65) Prior Publication Data

US 2010/0148433 A1 Jun. 17, 2010

(30) Foreign Application Priority Data

Dec. 12, 2008 (KR) ..... 10-2008-0126438

(51) Int. Cl.
*B65H 5/00* (2006.01)
*B43M 3/00* (2006.01)

(52) U.S. Cl. ..... 271/2; 271/225; 271/251; 156/441.5; 156/442.1; 156/442.2

(58) Field of Classification Search ..... 271/2, 225; 156/441.5, 442.1, 442.2, 443; 493/405, 419
See application file for complete search history.

(56) References Cited

U.S. PATENT DOCUMENTS 4,546,964 A * 10/1985 Linthout ..... 271/250
5,518,574 A * 5/1996 Yates et al. ..... 156/356
6,193,641 B1 * 2/2001 Barker ..... 493/420
7,018,507 B2 * 3/2006 Hsieh ..... 156/442.1
7,678,038 B1 * 3/2010 Stieber et al. ..... 493/442

* cited by examiner

*Primary Examiner* — Stefanos Karmis
*Assistant Examiner* — Luis A Gonzalez
(74) *Attorney, Agent, or Firm* — IPLA P.A.; James E. Bame

(57) ABSTRACT

A mail paper sealing apparatus is provided. The apparatus includes an input part, a compression roller part, a driving unit, and a convey accelerator. The input part supplies a mail paper. The compression roller part seals the folded mail paper conveyed from the input part. The driving unit generates a rotary force. The convey accelerator is provided between the input part and the compression roller part and adds a rotation frictional force to a top surface of one side of the mail paper in a convey direction.

13 Claims, 6 Drawing Sheets

MAIL PAPER SEALING APPARATUS

CROSS REFERENCE

This application claims foreign priority under Paris Convention and 35 U.S.C. §119 to each of Korean Patent Application No. 10-2008-0126438, filed 12 Dec. 2008 with the Korean Intellectual Property Office.

BACKGROUND OF THE INVENTION

1. Field of the Invention

The present invention relates to a mail paper sealing apparatus for sealing a folded mail paper. More particularly, the present invention relates to a mail paper sealing apparatus including an input part for automatically or manually supplying a mail paper and a convey accelerator provided on a convey path between compression rollers sealing the folded mail paper to accelerate only one side of the mail paper such that the mail paper is conveyed as being inclined by a predetermined angle with respect to a convey direction and enters the compression roller part starting at a corner of one side of a front end, thereby not only obtaining a greater compression effect through a gradual extension of a pressure area of the compression roller part starting at a center but also greatly reducing an impact noise generated at the time of compression.

2. Description of the Related Art

In general, enterprises holding massive members such as financial institutions, government offices, etc. use a mail paper sealing apparatus for reducing a manufacturing time of various kinds of GIRO papers, invitation cards, bills, etc. sent to the members, reducing a manufacturing cost or a delivery cost, and collectively performing rapid folding and sealing by multistage-folding a single sheet of mail paper whose both surfaces are recorded with contents and sealing an edge of the mail paper in order to meet a restricted time limit for treatment of a mail and mass manufacturing.

The mail paper sealing apparatus is a device for sequentially collectively performing processes of automatically or manually feeding, folding, and sealing a mail paper or automatically or manually inputting and sealing a previously folded mail paper. The mail paper sealing apparatus performs automatic folding and sealing and makes front/rear surfaces of one mail paper contact with each other on the basis of any folding line so as to complete one mail.

In general, a mail paper sealing apparatus includes a folding part for automatically folding a mail paper to seal the mail paper. However, without the folding part, the mail paper sealing apparatus can be constructed to be of various types of automatically or manually feeding a mail paper folded by a separate folding device or manually and sealing the mail paper with a press roller part.

Accordingly, as illustrated in FIG. 1, a general mail paper sealing apparatus includes a paper feeding part 1, a folding part 5, a compression roller part 9, and a driving unit 10.

In general, an edge of a mail paper is coated with a sealing adhesive. The mail paper can be constituted of either a single sheet or two outer and inner sheets. The mail paper is sequentially automatically fed through the paper feeding part 1 and conveyed to the folding part 5 and then, is multistage-folded in the folding part 5.

After that, the folded mail paper is conveyed to the compression roller part 9 and is finally sealed in the compression roller part 9 and then, is discharged outside.

The compression roller part 9 includes a pair of press rollers 9*a* and 9*b* and thus, simultaneously presses and compression-seals a top surface and bottom surface of the conveyed mail paper.

In conclusion, the mail paper is automatically fed from the paper feeding part 1 and, while sequentially passing through the folding part 5 and the compression roller part 9, is automatically folded according to defined standards and then is sealed and discharged.

However, the conventional mail paper sealing apparatus has the following problems.

First, a front end of the mail paper folded in the folding part 5 enters between the pair of press rollers 9*a* and 9*b* of the compression roller part 9 with keeping right angles with a convey direction and therefore, the press rollers 9*a* and 9*b* simultaneously press the whole surface of the front end of the folded mail paper. By doing so, the press rollers 9*a* and 9*b* suffer warp and comes off at a center and thus, its compression quality is deteriorated. Accordingly, there is a need for large-sized press rollers 9*a* and 9*b* of relatively large diameters being able to guarantee a greater compression force for the purpose of preventing the warp. However, there is a problem of remarkably increasing a manufacturing cost of a compression roller part 9.

Second, the whole surface of the front end of the mail paper simultaneously rapidly enters between the press rollers 9*a* and 9*b* and then, the whole surface of a rear end is simultaneously released from the press rollers 9*a* and 9*b*. Because of this, there is a problem that an impact noise increases when the mail paper is advanced into or is discharged out the compression roller part 9.

SUMMARY OF THE INVENTION

An aspect of exemplary embodiments of the present invention is to address at least the problems and/or disadvantages and to provide at least the advantages described below. Accordingly, an aspect of exemplary embodiments of the present invention is to provide a mail paper sealing apparatus including a convey accelerator for adding a rotation frictional force to one side of a top surface of the mail paper on a convey path between an input part for supplying a mail paper and compression rollers sealing the mail paper such that a front end of the mail paper is conveyed as being inclined by a predetermined angle with respect to a convey direction, whereby, firstly, the mail paper can enter the compression roller part starting at a corner of one side of a front end of the mail paper and a press area of a press roller can gradually extend starting at a center, thereby making it possible to improve a compression quality of a center of the mail paper despite generation of warp and, secondly, it is allowed to obtain a greater compression effect with a miniature press roller of a relatively small diameter, thereby enabling the use of the miniature press roller and, thirdly, after the mail paper enters starting at a corner, a compression area of the mail paper gradually extends, thereby being able to remarkably reduce an impact noise generated when the mail paper is advanced into or discharged out the compression roller part.

To achieve these and other advantages and in accordance with the purpose of the present invention, there is provided a mail paper sealing apparatus. The apparatus includes an input part, a compression roller part, a driving unit, and a convey accelerator. The input part supplies a mail paper. The compression roller part seals the folded mail paper conveyed from the input part. The driving unit generates a rotary force. The convey accelerator is provided between the input part and the compression roller part and adds a rotation frictional force to a top surface of one side of the mail paper in a convey direction such that the mail paper from the input part is conveyed as being inclined by a predetermined angle with respect to the convey direction and enters the compression roller part starting at a corner of one side of a front end.

The convey accelerator includes a rotation support member, a rotary shaft, and a rotor. The rotation support member is fixedly coupled to a main frame and has a shaft insertion hole through-formed at a center. The rotary shaft is rotatably through-coupled into the shaft insertion hole of the rotation support member and is rotated by receiving a rotary force from the external. The rotor is coupled to one end of the rotary shaft and presses a top surface of the mail paper during rotation such that a rotary force of the rotary shaft is added to the mail paper.

BRIEF DESCRIPTION OF THE DRAWINGS

The above and other objects, features and advantages of the present invention will become more apparent from the following detailed description when taken in conjunction with the accompanying drawings in which.

Throughout the drawings, the same drawing reference numerals will be understood to refer to the same elements, features and structures.

DETAILED DESCRIPTION OF THE INVENTION

Exemplary embodiments of the present invention will now be described in detail with reference to the annexed drawings. In the following description, a detailed description of known functions and configurations incorporated herein has been omitted for conciseness.

Figure 1:
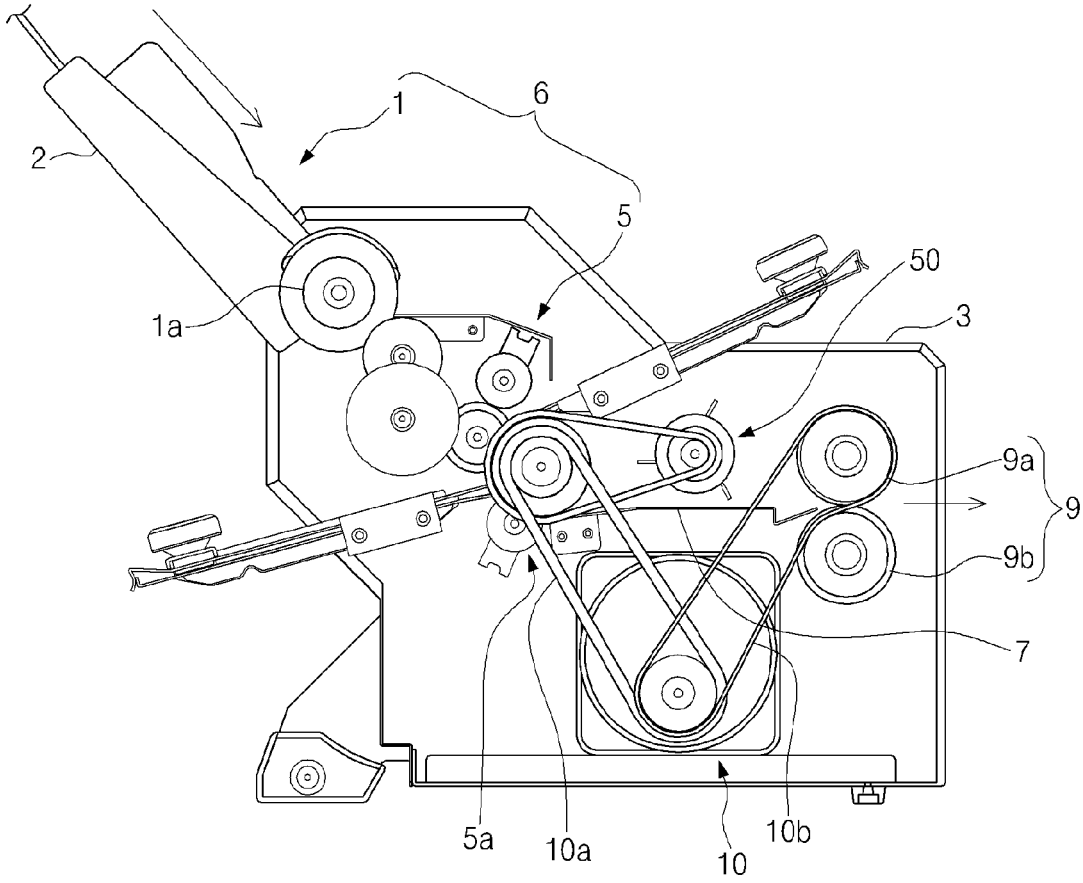
FIG. 1 is a schematic side diagram illustrating a mail paper sealing apparatus according to an exemplary embodiment of the present invention.
Figure 2:
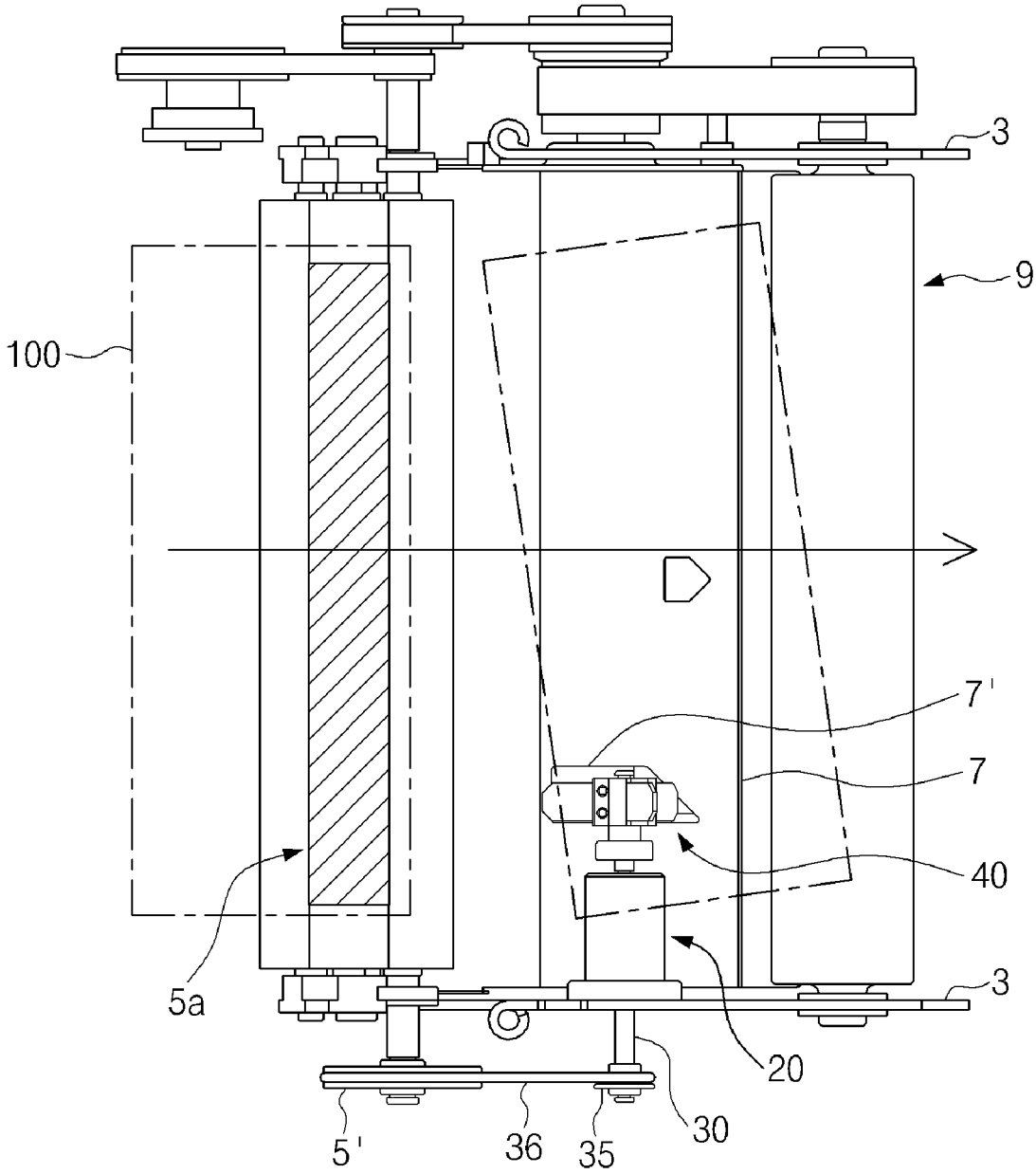
FIG. 2 is a partial plane diagram of FIG. 1.

FIG. 1 is a schematic side diagram illustrating a mail paper sealing apparatus with a convey accelerator 50 of the present invention. FIG. 2 is a schematic partial plane diagram of FIG. 1.

As illustrated in FIGS. 1 and 2, the mail paper sealing apparatus of the present invention includes an input part 6, a compression roller part 9, a driving unit 10, and the convey accelerator 50.

The input part 6 includes a feeding part 1 and a folding part 5 but does not intend to limit the scope of the present invention. Without the automatic feeding part 1 or the folding part 5, the input part 6 can be constructed to just manually supply and convey a folded mail paper 100 to the compression roller part 9.

That is, the input part 6 can be of a structure of inputting a previously folded mail paper 100, and can be a structure in which, after folding the mail paper 100 by hands, a worker inputs the folded mail paper 100 using the automatic feeding part 1 or manually such that the mail paper 100 can be input to the compression roller part 9 via the convey accelerator 50.

The feeding part 1 successively automatically feeds the mail paper 100 (shown in FIG. 2), and has a feed tray 2 being slanted and housing a predetermined amount of mail papers 100.

The mail paper 100 is loaded on the feed tray 2 and then is sequentially input to the folding part 5 by a feed roller 1*a*.

The folding part 5 multistage-folds the mail paper 100 conveyed from the feeding part 1 according to defined standards, automatically folds the mail paper 100 in a two-stage or three-stage manner, and conveys the folded mail paper 100 to the compression roller part 9.

At this time, the folding part 5 accelerates the folded mail paper 100 by a rotary force of a pair of discharge rollers 5*a* and sliding the mail paper 100 on a support plate 7, thereby conveying the mail paper 100 to the compression roller part 9.

The compression roller part 9 simultaneously presses and seals a top surface and bottom surface of the folded mail paper 100. The compression roller part 9 includes a pair of press rollers 9*a* and 9*b* formed of metal.

The upper and lower press rollers 9*a* and 9*b* are installed in a main frame 3 to be rotatable at both ends and be parallel with each other at top and bottom sides such that they are operable in a direction of rotating in engagement with each other. Outer circumference surfaces of the upper and lower press rollers 9*a* and 9*b* are maintained as being minutely spaced apart by an interval slightly less than a thickness of the folded mail paper 100 such that the mail paper 100 can be effectively pressed and sealed during passing.

Thus, while the mail paper 100 sequentially passes through the feeding part 1, the folding part 5, and the compression roller part 9, the mail paper 100 is automatically folded according to defined standards and then is sealed and discharged outside.

The folding part 5 and the compression roller part 9 simultaneously receive a rotary force from the driving unit 10 by belts 10*a* and 10*b* and are operated.

Figure 4:
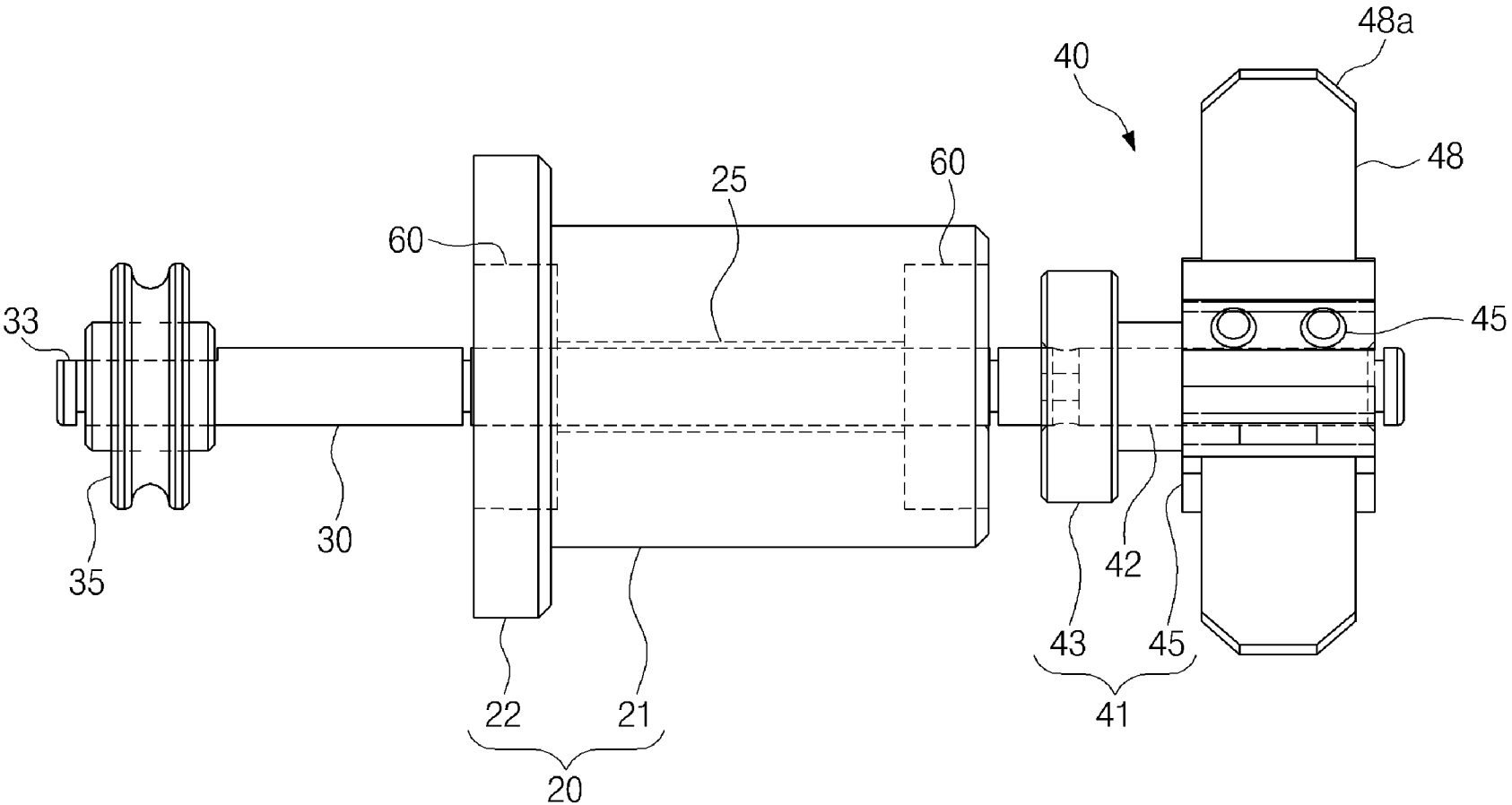
FIG. 4 is a side diagram of FIG. 3.
Figure 5:
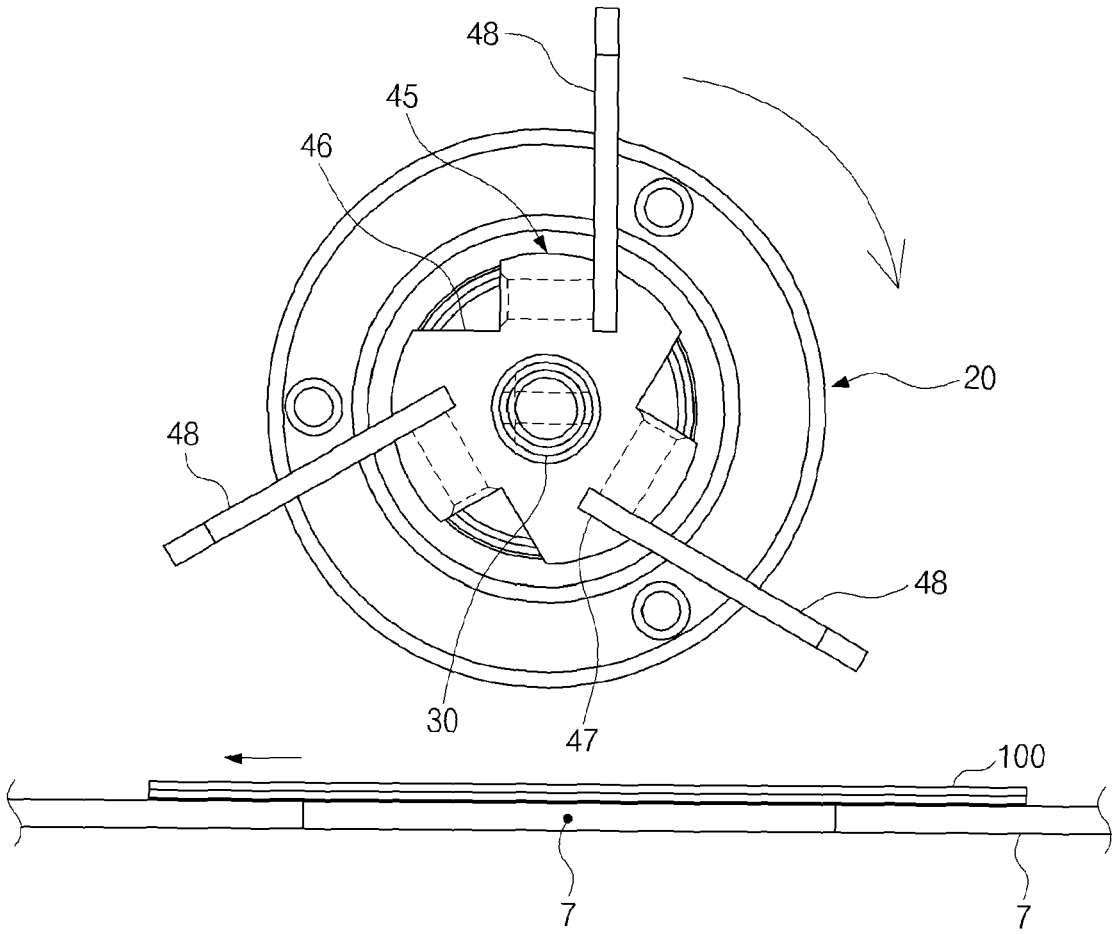
FIG. 5 is a diagram illustrating an operation state of a convey accelerator according to the present invention.

The convey accelerator is described below in detail with reference to FIGS. 3 to 5.

Figure 3:
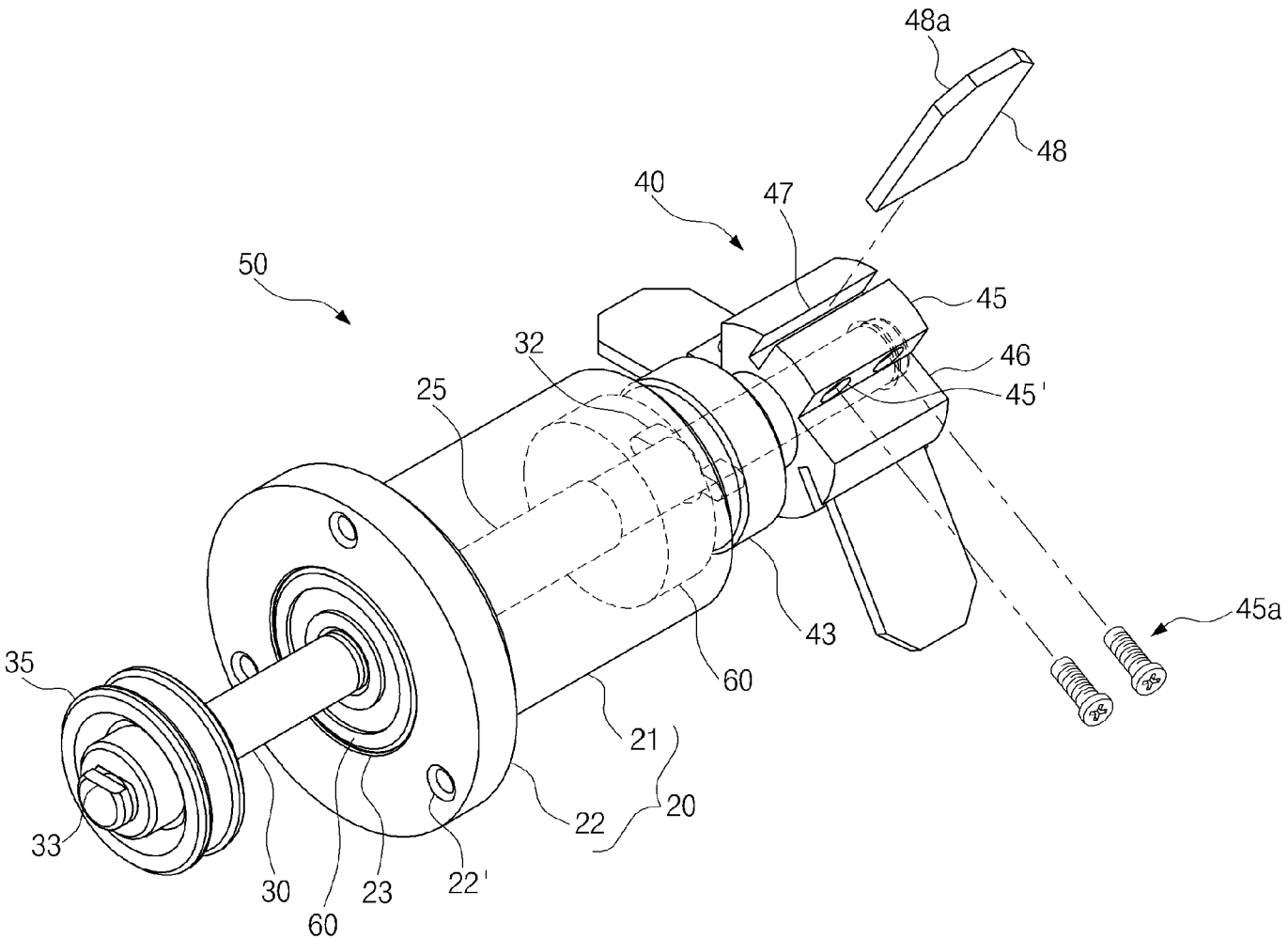
FIG. 3 is a partial exploded perspective diagram illustrating a convey accelerator included in a mail paper sealing apparatus according to the present invention.

FIG. 3 is a partial exploded perspective diagram illustrating a convey accelerator 50 included in a mail paper sealing apparatus according to the present invention. FIG. 4 is a side diagram of the convey accelerator 50 of FIG. 3. FIG. 5 is a diagram illustrating an operation state of the convey accelerator 50 according to the present invention.

As illustrated in FIG. 3, the convey accelerator 50 of the present invention is installed on a convey path between the folding part 5 of the input part 6 and the compression roller part 9. The convey accelerator 50 includes a rotation support member 20, a rotary shaft 30, and a rotor 40.

The rotation support member 20 is fixed to the main frame 3 and supports rotation of the rotary shaft 30. The rotation support member 20 includes a body 21 and a flange 22.

The body 21 is of a cylindrical shape of a predetermined length having a shaft insertion hole 25 passing through a center, and the flange 22 is provided at one end of the body 21.

The flange 22 is formed to have a cylindrical shape of a predetermined thickness having a greater diameter than the body 21, and has a plurality of coupling holes 22' through-formed at an equal interval along a circumference.

The rotation support member 20 is fixed by adhering the flange 22 to an inner surface of the main frame 3 and screw-coupling the flange 22 through the coupling holes 22'.

Bearings 60 are each inner-installed at both sides of the rotation support member 20 to more effectively rotation-support the rotary shaft 30. The bearings 60 may be coupled by forming a circular housing groove 23 of a predetermined depth concentric with the shaft insertion hole 25 and then pressing and inserting the bearings 60 into the circular housing groove 23.

The rotation support member 20 is not limited to the above structure but can have one bearing installed at a center or can use a bush, etc. for supporting rotation.

The rotary shaft 30 receives a rotary force of the driving unit 10 from the discharge rollers 5*a* of the folding part 5 and rotate in the same direction as the discharge rollers 5*a*. The rotary shaft 30 is installed to be through-coupled to the bearings 60 of the rotation support member 20.

In order to prevent an axial movement, the rotary shaft 30 can be coupled with a fixing ring (not shown) such as an 'E'-ring, etc. that can be supported by each of both end surfaces of the rotation support member 20.

A driving wheel 35 is installed at one end of the rotary shaft 30.

The driving wheel 35 is rotatably coupled integrally with the rotary shaft 30. The driving wheel 35 connects with the discharge roller 5*a* of the folding part 5 by the belt 36 (shown in FIG. 2), thus receiving a rotary force of the driving unit 10 from the folding part 5 and rotating the rotary shaft 30.

The driving wheel 35 can be inserted and coupled to a cutaway part 33 formed at an end of the rotary shaft 30 and then, is fixed with a fixing ring, etc.

The driving wheel 35 is formed to have a diameter suitable to rotate the rotary shaft 30 such that the rotor 40 described below can rotate somewhat faster than a convey speed of the mail paper 100 and accelerate the mail paper 100.

The belt 36 can be various types of belts such as a circular belt, a 'V'-belt, a timing belt, etc. Also, in addition to belt connection, gear coupling, etc. may be used to deliver a rotary force.

The rotor 40 is coupled to an end of the rotary shaft 30 to be rotatable integrally with the rotary shaft 30 and adds a rotation frictional force to a top surface of the folded mail paper 100 that is conveyed to the compression roller part 9 from the folding part 5. The rotor 40 includes a support holder 41 and a rubber paddle 48.

The support holder 41 has a shaft insertion hole 42 through-formed at a center to insert the rotary shaft 30. The support holder 41 has a shaft fixing part 43 formed at one end, and has a paddle fixing part 45 formed at the other end to fixing the rubber paddle 48.

The shaft fixing part 43 is coupled to the rotary shaft 30 such that the support holder 41 can rotate integrally with the rotary shaft 30. The shaft fixing part 43 has insertion grooves (not shown) for inserting protrusions 32 protruded and formed on outer circumference surfaces of the rotary shaft 30. The insertion grooves are each formed in positions corresponding to the protrusions 32.

Thus, the support holder 41 is outer-inserted to the rotary shaft 30 such that the protrusions 32 of the rotary shaft 30 can be inserted into the insertion grooves of the shaft fixing part 43, whereby the support holder 41 is rotatable integrally with the rotary shaft 30.

In addition to the aforementioned method, the shaft fixing part 43 may be fixed to the rotary shaft 30 using a setscrew, etc.

Paddle insertion grooves 47 are radially formed at an equal interval to have predetermined depths along an outer circumference surface of the paddle fixing part 45. Cutaway parts 46 are each formed between the paddle insertion grooves 47 to couple a fixing screw 45*a* for fixing the rubber paddle 48.

The paddle insertion grooves 47 can be formed to direct to a center of the rotary shaft 30. Unlike this, as illustrated in FIG. 5, the paddle insertion grooves 47 may be formed to be slightly eccentric to one side from the center of the rotary shaft 30 such that, when the support holder 41 is rotated as indicated by an arrow, an end of the rubber paddle 48 can more effectively contact with a top surface of the mail paper 100.

The rubber paddle 48 is formed of elastic rubber of a proper length. By this, when the support holder 41 rotates, the end of the rubber paddle 48 can be deformed and contacted while slightly pressing the top surface of the mail paper 100. Cutting parts 48*a* can be formed at corners of both sides of a top end surface of the rubber paddle 48.

The rubber paddle 48 is fixed by inserting bottom ends of the rubber paddles 48 into the paddle insertion grooves 47, coupling the fixing screws 45*a* to a plurality of coupling holes 45' through-formed from the cutaway part 46 to the paddle insertion groove 47, and pressing a side surface of the rubber paddle 48 by front ends of the fixing screws 45*a*.

An axial movement of the support holder 41 may be prevented by the fixing ring (i.e., the 'E'-ring, etc.) installed at an end of the rotary shaft 30.

An operation process of the mail paper sealing apparatus of the present invention is described below in detail with reference to FIGS. 2 and 5.

As illustrated in FIG. 2, the mail paper 100 is continuously fed from the feeding part 1 (shown in FIG. 1) of the input part 6 and passes through the folding part 5 during folding and then, is discharged at a predetermined speed to the front through the discharge rollers 5*a* of the folding part 5.

The mail paper 100 is discharged out of the folding part 5 and is slid and conveyed on a top surface of the support plate 7 provided between the folding part 5 and the compression roller part 9 by a rotary force of the discharge rollers 5*a*. After that, a front end of the mail paper 100 enters and compressed between the upper and lower press rollers 9*a* and 9*b* of the compression roller part 9.

The press rollers 9*a* and 9*b* receiving a rotary force of the driving unit 10 and rotating in a direction opposite to each other simultaneously press and seal the top and bottom surfaces of the input mail paper 100 and then discharge the mail paper 100.

Because the rotary shaft 30 of the convey accelerator 50 connects by the belt 36 with a driving wheel 5' provided in the discharge roller 5*a* of the folding part 5, the rotary shaft 30 rotates in the same direction as the discharge roller 5*a*. Because the driving wheel 35 is formed to have a smaller diameter than the driving wheel 5' of the discharge roller 5*a*, the driving wheel 35 rotates relatively faster than the discharge roller 5*a*.

When a rear end of the mail paper 100 is released out of the discharge roller 5*a* of the folding part 5 and is slid on the support plate 7, the rubber paddle 48 provided in the rotor 40 of the convey accelerator 50 periodically contacts with a partial top surface of the mail paper 100 during rotation and, at the same time, presses the mail paper 100 and adds the rotation frictional force, thereby accelerating one side of the mail paper 100 in a convey direction.

The support plate 7 has a through-hole 7' formed at its one side such that, upon rotation of the rotor 40, the support plate 7 does not interfere with the rubber paddle 48, thus preventing the rubber paddle 48 from directly contacting with the support plate 7 and generating unnecessary noise or damage.

Thus, the rubber paddle 48 of the rotor 40 periodically presses a partial top surface of the mail paper 100 during rotation and adds a rotation frictional force. By the rubber paddle 48, one side of the mail paper 100 is accelerated and conveyed relatively faster than the other side. By doing so, a skew phenomenon occurs in which the mail paper 100 is conveyed as being slightly inclined by a predetermined angle with respect to a convey direction whereby the mail paper 100 travels to the compression roller part 9 starting at a corner of one side of a front end of the mail paper 100.

A sealing work of the mail paper 100 is achieved gradually extending to the whole surface starting at a corner of a front end. Also, when being discharged out of the compression roller part 9, the mail paper 100 is discharged starting at the corner of the front end, and completes the discharge while a corner of a rear end finally gets out of.

In another implementation, a mail paper sealing apparatus can be of a simple structure including an input part 6 with no automatic feeding part 1 and folding part 5 and a compression roller part 9 and directly inputting and sealing a previously folded mail paper 100. Even the mail paper sealing apparatus may generate a skew in the mail paper 100 using a convey accelerator 50 installed at one side of the first part of a compression roller part 9.

Thus, the present invention is effectively applicable to mail paper sealing apparatuses of various structures sealing a variety of mail papers 100 folded in a multistage such as a two-stage, a three-stage, etc.

Figure 6:
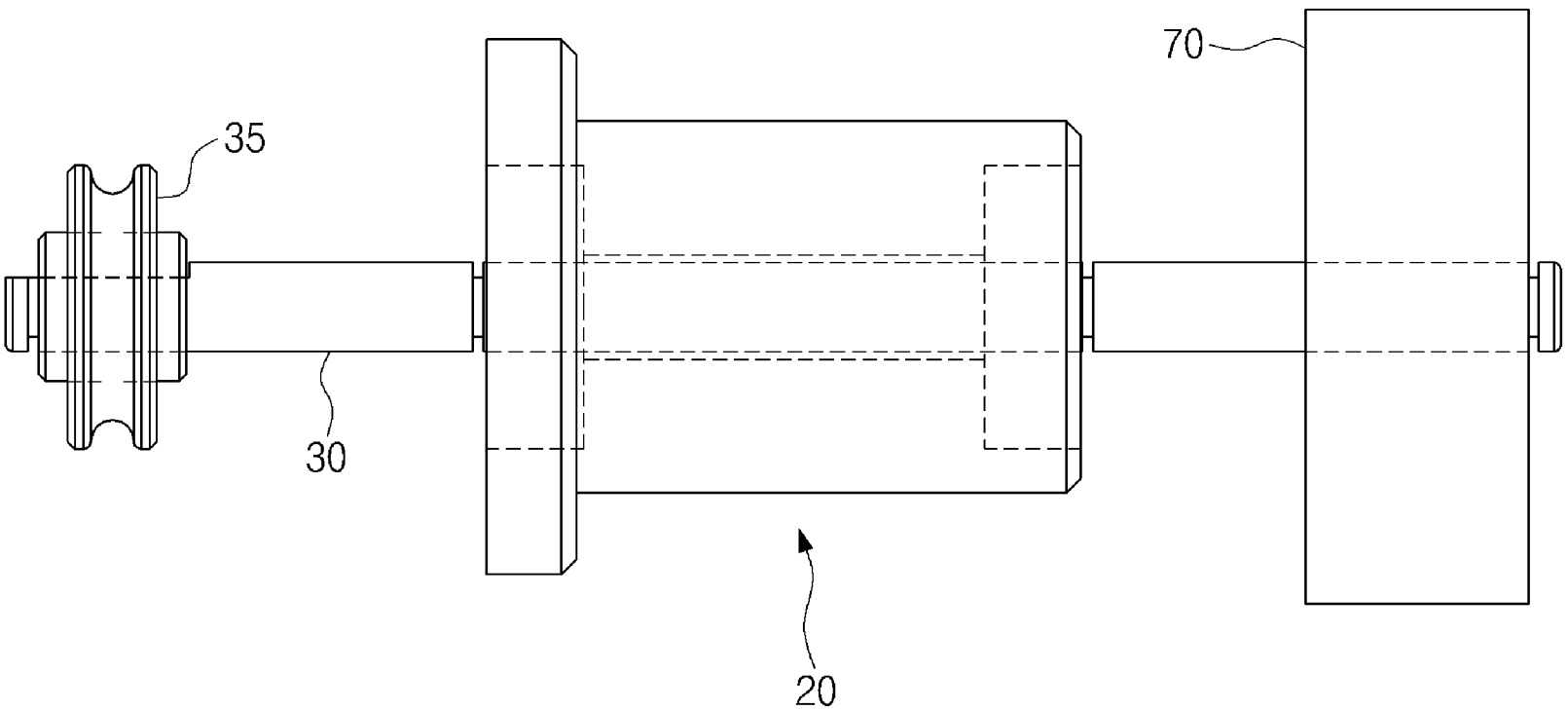
FIG. 6 is a side diagram illustrating a convey accelerator according to another exemplary embodiment of the present invention.

FIG. 6 illustrates a convey accelerator according to another exemplary embodiment of the present invention. Other than a construction of a rotor 70 is the same as that of the aforementioned exemplary embodiment and thus, only a modified construction is described below.

As illustrated in FIG. 6, the rotor 70 is a cylindrical sponge roller formed to have a predetermined diameter.

The sponge roller 70 is out-inserted and coupled to the rotary shaft 30 to be rotatable integrally with the rotary shaft 30. The sponge roller 70 is formed of a cylindrical sponge having sufficient elasticity.

A diameter of the sponge roller 70 is provided such that, upon rotation, the sponge roller 70 slightly presses a top surface of the mail paper 100 while adding a rotation frictional force to accelerate one side part of the mail paper 100 in the same method as that of the aforementioned exemplary embodiment.

In the present invention, the mail paper 100 is accelerated at one side by the convey accelerator 50 provided on the convey path between the input part 6 and the compression roller part 9, a front end of the mail paper 100 is conveyed as being inclined by a predetermined angle with respect to a convey direction, and the mail paper 100 enters the compression roller part 9 starting at a corner of one side of a front end of the mail paper 100 and then is discharged. By doing so, the present invention can obtain a greater compression effect, make it possible to use a miniature press roller having a relative small diameter, and remarkably reduce an impact noise generated when the mail paper 100 is advanced into or discharged out of the compression roller part 9.

As described above, the present invention has an effect that, when a mail paper enters between a pair of press rollers of a press roller part, the mail paper enters starting at a corner of a front end and then a press area gradually extends, thereby making it possible to obtain a greater compression effect with a miniature compression roller of a relative small diameter and reducing a manufacturing cost and also remarkably reducing an impact noise generated when the mail paper is advanced or discharged by the upper and lower press rollers, thus being able to improve a quality of a product and merchantability.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A mail paper sealing apparatus comprising:
- an input part for supplying a mail paper;
- a compression roller part disposed in parallel to the input part for sealing the folded mail paper conveyed from the input part;
- a driving unit for generating a rotary force; and
- a convey accelerator provided between the input part and the compression roller part and configured to apply a rotation frictional force to a top surface of one side of the mail paper in a convey direction and incline the mail paper conveyed from the input part by a predetermined angle other than zero (0) degree with respect to the convey direction such that the mail paper enters the compression roller part starting at a corner of one side of a front end.

2. The apparatus of claim 1, wherein the convey accelerator comprises:
- a rotation support member fixedly coupled to a main frame and having a shaft insertion hole through-formed at a center;
- a rotary shaft rotatably through-coupled into the shaft insertion hole of the rotation support member and rotated by receiving a rotary force from the external; and
- a rotor coupled to one end of the rotary shaft and pressing a top surface of the mail paper during rotation such that a rotary force of the rotary shaft is added to the mail paper.

3. The apparatus of claim 2, wherein the rotor is a sponge roller pressing the top surface of the mail paper by a predetermined elastic force during rotation.

4. The apparatus of claim 2, wherein the rotor comprises:
- a support holder coupled to the rotary shaft; and
- rubber paddles of predetermined lengths radially installed to be spaced an equal interval apart along an outer circumference surface of the support holder and provided to periodically press the top surface of the mail paper while adding a rotation frictional force.

5. The apparatus of claim 4, wherein the rubber paddles are installed to be eccentric to one side with respect to a center of rotation of the rotary shaft such that ends can more effectively contact with the top surface of the mail paper.

6. The apparatus of claim 2, wherein the rotation support member comprises:
- a body of a predetermined length having the shaft insertion hole formed at a center; and
- a flange part provided at an outer circumference surface of one end of the body and fixedly coupled to the main frame, wherein bearings are each inner-installed at both ends of the body to rotation-support the rotary shaft.

7. The apparatus of claim 2, wherein a support plate is installed between the input part and the compression roller part to support convey of the mail paper, and has a through-hole in order not to interfere with the rotor.

8. A mail paper sealing apparatus comprising:
- an input part for supplying a mail paper;
- a compression roller part for sealing the folded mail paper conveyed from the input part;
- a driving unit for generating a rotary force; and
- a convey accelerator provided between the input part and the compression roller part and adding a rotation frictional force to a top surface of one side of the mail paper in a convey direction such that the mail paper conveyed from the input part is conveyed as being inclined by a predetermined angle with respect to the convey direction and enters the compression roller part starting at a corner of one side of a front end, wherein the convey accelerator comprises:

a rotation support member fixedly coupled to a main frame and having a shaft insertion hole through-formed at a center;

a rotary shaft rotatably through-coupled into the shaft insertion hole of the rotation support member and rotated by receiving a rotary force from the external; and a rotor coupled to one end of the rotary shaft and pressing a top surface of the mail paper during rotation such that a rotary force of the rotary shaft is added to the mail paper.

9. The apparatus of claim 8, wherein the rotor is a sponge roller pressing the top surface of the mail paper by a predetermined elastic force during rotation.

10. The apparatus of claim 8, wherein the rotor comprises:

a support holder coupled to the rotary shaft; and rubber paddles of predetermined lengths radially installed to be spaced an equal interval apart along an outer circumference surface of the support holder and provided to periodically press the top surface of the mail paper while adding a rotation frictional force.

11. The apparatus of claim 10, wherein the rubber paddles are installed to be eccentric to one side with respect to a center of rotation of the rotary shaft such that ends can more effectively contact with the top surface of the mail paper.

12. The apparatus of claim 8, wherein the rotation support member comprises:

a body of a predetermined length having the shaft insertion hole formed at a center; and a flange part provided at an outer circumference surface of one end of the body and fixedly coupled to the main frame, wherein bearings are each inner-installed at both ends of the body to rotation-support the rotary shaft.

13. The apparatus of claim 8, wherein a support plate is installed between the input part and the compression roller part to support convey of the mail paper, and has a through-hole in order not to interfere with the rotor.

* * * * *